US005902058A

United States Patent [19]

Koike et al.

[11] Patent Number: 5,902,058

[45] Date of Patent: May 11, 1999

[54] SHEET CONVEYING APPARATUS AND IMAGE FORMING APPARATUS

[75] Inventors: Yasushi Koike, Kawasaki; Shoichi Kan; Nozomu Nishiberi, both of Yokohama, all of Japan

[73] Assignee: Canon Kabushiki Kaisha, Tokyo, Japan

[21] Appl. No.: 08/869,923

[22] Filed: Jun. 5, 1997

[30] Foreign Application Priority Data

Jun. 7, 1996 [JP] Japan ..... 8-145786
Jun. 3, 1997 [JP] Japan ..... 9-144931

[51] Int. Cl.[6] ..... B41J 13/00

[52] U.S. Cl. ..... 400/578; 400/567; 400/569; 400/577; 74/409

[58] Field of Search ..... 400/577, 578, 400/641, 567, 569; 74/409

[56] References Cited

U.S. PATENT DOCUMENTS

| | | | |
|---|---|---|---|
| 4,630,496 | 12/1986 | Yasuoka | 74/409 |
| 4,976,557 | 12/1990 | Uchikata | 400/565 |
| 5,051,014 | 9/1991 | Takagi et al. | 400/625 |
| 5,141,346 | 8/1992 | Nakagawa | 400/605 |
| 5,328,280 | 7/1994 | Ito | 400/596 |
| 5,348,131 | 9/1994 | Yamaguchi et al. | 198/330 |

FOREIGN PATENT DOCUMENTS

| | | |
|---|---|---|
| 0 382 640 | 8/1990 | European Pat. Off. . |
| 0 517 401 | 12/1992 | European Pat. Off. . |
| 42 07 953 | 9/1993 | Germany . |
| 4-23664 | 1/1992 | Japan . |

*Primary Examiner*—Edgar Burr
*Assistant Examiner*—Dave A Ghatt
*Attorney, Agent, or Firm*—Fitzpatrick, Cella, Harper & Scinto

[57] ABSTRACT

The present invention provides a sheet conveying apparatus for conveying a sheet comprising a convey member for applying a conveying force to a sheet, a drive source for driving the convey member, and a drive transmitting means for transmitting a drive force from a first drive transmitting member attached to the drive source to a second drive transmitting member attached to the convey member through one or more speed reduction members stepwisely. Among the first drive transmitting member, second drive transmitting member and speed reduction members, manufacturing accuracy of the speed reduction member disposed at a front stage of the second drive transmitting member is greater than manufacturing accuracies of the other members.

12 Claims, 13 Drawing Sheets

SHEET CONVEYING APPARATUS AND IMAGE FORMING APPARATUS

BACKGROUND OF THE INVENTION

1. Field of the Invention

The present invention relates to a sheet conveying apparatus for conveying a sheet member such as a recording sheet and an image forming apparatus using such a sheet conveying apparatus.

2. Related Background Art

Image forming apparatuses having a pin-feed tractor have been used as output equipments for personal computers, word processors, facsimiles and the like.

In a conventional example shown in FIG. 14, a convey roller 50 and driven pinch rollers 51*a,* 51*b* for urging a sheet against the convey roller are used as sheet convey means. A so-called U-turn path is provided for conveying the sheet around the convey roller 50.

When a cut sheet is used as a recording medium, the cut sheet is pinched between the convey roller 50 and the pinch rollers 51*a,* 51*b,* thereby conveying the sheet by friction forces generated between these rollers. On the other hand, when a continuous sheet (also referred to as "fan-fold sheet" hereinafter) is used, pin holes formed in the fan-fold sheet are engaged by pins 52*a* of a pin-feed tractor 52, and the sheet is pinched between the convey roller 50 and the pinch rollers 51*a,* 51*b,* thereby conveying the sheet to a recording portion by friction forces generated between these rollers.

In any case, the recording is effected by a recording head 53 regarding the conveyed sheet, and thereafter, the sheet is shifted upwardly and discharged out of the apparatus by a discharge roller 54*a* and a pinch roller 54*b* for urging the sheet against the discharge roller. In the image forming apparatus having the U-turn path, an inlet opening and a discharge opening for the fan-fold sheet can be arranged at a rear portion of the apparatus, and the selection of and the switching between the fan-fold sheet and the cut sheet can be performed by manipulating a lever, in a condition that the sheets were set.

However, in order to convey several kinds of sheets (particularly, sheets having great resiliency such as post cards, envelopes and the like), it is necessary that a diameter of the convey roller 50 is increased to reduce load resistance. Further, in the image forming apparatus, when the sheet is intermittently conveyed by a predetermined amount, the smaller the diameter of the convey roller 50 the greater the rotational angle of the convey roller 50. To the contrary, although the greater the diameter of the convey roller 50 the smaller the rotational angle, it is hard to be influenced upon eccentricity of the convey roller 50.

Accordingly, the large diameter of the convey roller not only reduces the load resistance in the U-turn path, but also eliminates one of factors for worsening conveyance accuracy of the convey roller 50.

On the other hand, in view of serial-recording, the intermittent conveyance of sheet requires high accuracy; if the accuracy is poor, one-line recording area obtained by one scan of the recording head will be overlapped with the previous one-line recording area or be excessively spaced apart from the previous one-line recording area, thereby worsening the recording quality greatly. In many cases, in drive force transmission in a sheet conveying apparatus, a rotational force of a motor is transmitted to the convey roller through gears and/or belt; in order to provide predetermined torque of the convey roller, the drive force is transmitted with speed reduction. The most preferential factor for giving the influence upon the sheet conveyance accuracy is eccentricity of drive force transmitting members (such as gears, belt and the like) and eccentricity of the convey roller. In order to minimize the influence of such eccentricity, various efforts for improving the accuracy of such elements have been tried.

On the other hand, when the diameter of the convey roller 50 is increased, the speed reduction ratio of the rotational force of the motor and the number of speed reduction steps or stages are increased, the conveyance accuracy of the convey roller 50 is worsened.

As mentioned above, although it is desirable to improve the manufacturing accuracy of the drive force transmitting members and speed reduction members (such as gears) in order to enhance the conveyance accuracy, there are technical limitations and increase in cost. If the diameter of the convey roller 50 is decreased, certain kinds of sheets including the fan-fold sheet cannot be handled and the advantage of the U-turn path cannot be utilized.

SUMMARY OF THE INVENTION

The present invention intends to eliminate the above-mentioned conventional drawbacks, and has an object to provide a sheet conveying apparatus and an image forming apparatus, which can handle several kinds of sheets by suppressing the influence of eccentricity of sheet conveying members and speed reduction members, and in which, even when a speed reduction ratio of a rotational force of a drive source is increased, the conveyance accuracy can be maintained.

To achieve the above object, in the present invention, a sheet conveying apparatus comprises a convey member for applying a conveying force to a sheet, a drive source for driving the convey member, and a drive transmitting means for transmitting a drive force, with multi-stages, from a first drive transmitting member attached to the drive source to a second drive transmitting member attached to the convey member through one or more speed reduction members. Among the first drive transmitting member, second drive transmitting member and speed reduction members, manufacturing accuracy of the speed reduction member disposed at a front stage of the second drive transmitting member is greater than manufacturing accuracies of the other members.

With the above arrangement, by increasing the manufacturing accuracy of one speed reduction member which is most effective, conveyance accuracy can be improved while suppressing increase in cost. As a result, in the image forming apparatus having such a sheet conveying apparatus, good recording accuracy can be obtained.

Further, when the sheet is intermittently conveyed by a predetermined amount, by designing the speed reduction member disposed at the front stage of the second drive transmitting member has a speed reduction ratio wherein such speed reduction member is rotated by integral number, the influence of the eccentricity can be cancelled, thereby achieving high accurate conveyance.

DETAILED DESCRIPTION OF THE PREFERRED EMBODIMENTS

Now, a sheet conveying apparatus and an image forming apparatus using such a sheet conveying apparatus according to an embodiment of the present invention will be explained with reference to FIGS. 1 to 4, 5A and 5B, 6, 7, 8A and 8B, 9 to 13.

In the ink jet image forming apparatus according to the illustrated embodiment, a cut sheet such as a plain sheet, a post card and the like, and a continuous sheet such as a fan-fold sheet can be conveyed. That is to say, when a cut sheet is used, normally, the sheet is supplied by using an ASF (auto sheet feeder) 1 or by manual sheet insertion.

Figure 1:
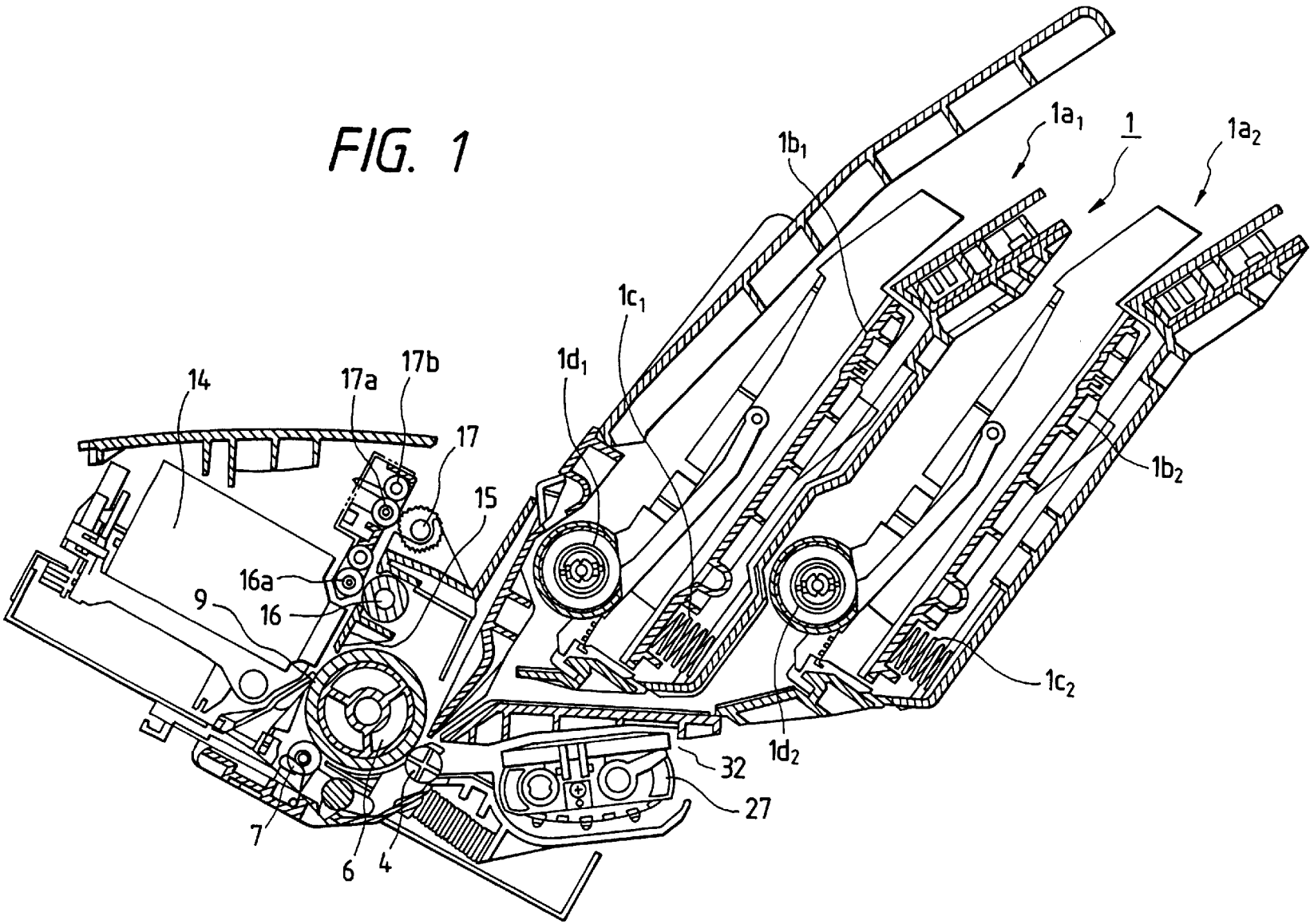
FIG. 1 is a sectional view of a main portion of an image forming apparatus on which two automatic sheet feeding units are mounted.
Figure 2:
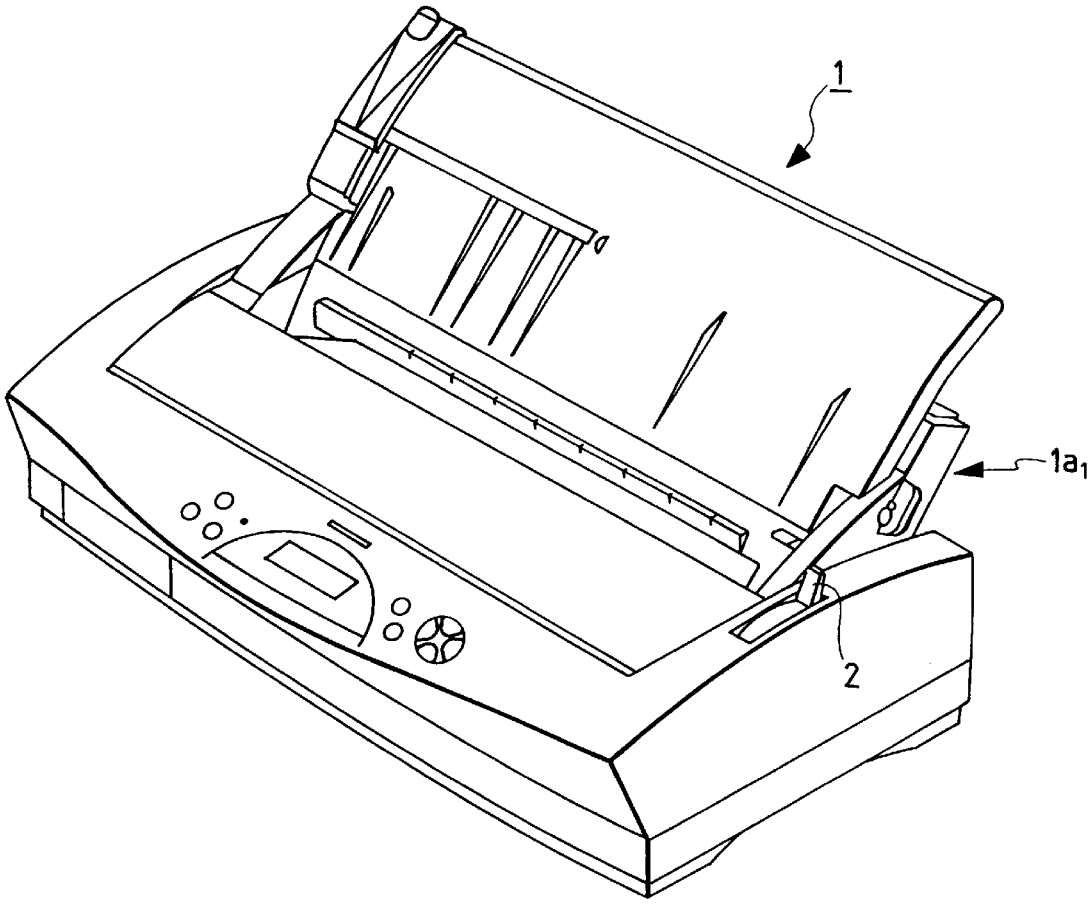
FIG. 2 is a perspective view of an image forming apparatus on which a single automatic sheet feeding units are mounted.

As shown in FIG. 1, the ASF 1 comprises two bins 1*a*1, 1*a*1 so that two kinds of cut sheets having different size can be simultaneously set and one of such cut sheets can be selected by an operator. Sheet supply mechanisms of bins 1*a*1, 1*a*2 are the same as each other. That is to say, the cut sheets (not shown in FIG. 1) stacked on pressure plates 1*b*1, 1*b*2 are separated and supplied one by one, by pick-up rollers 1*d*1, 1*d*2 against which the sheets are urged by urging forces of springs 1*c*1, 1*c*2.

Figure 4:
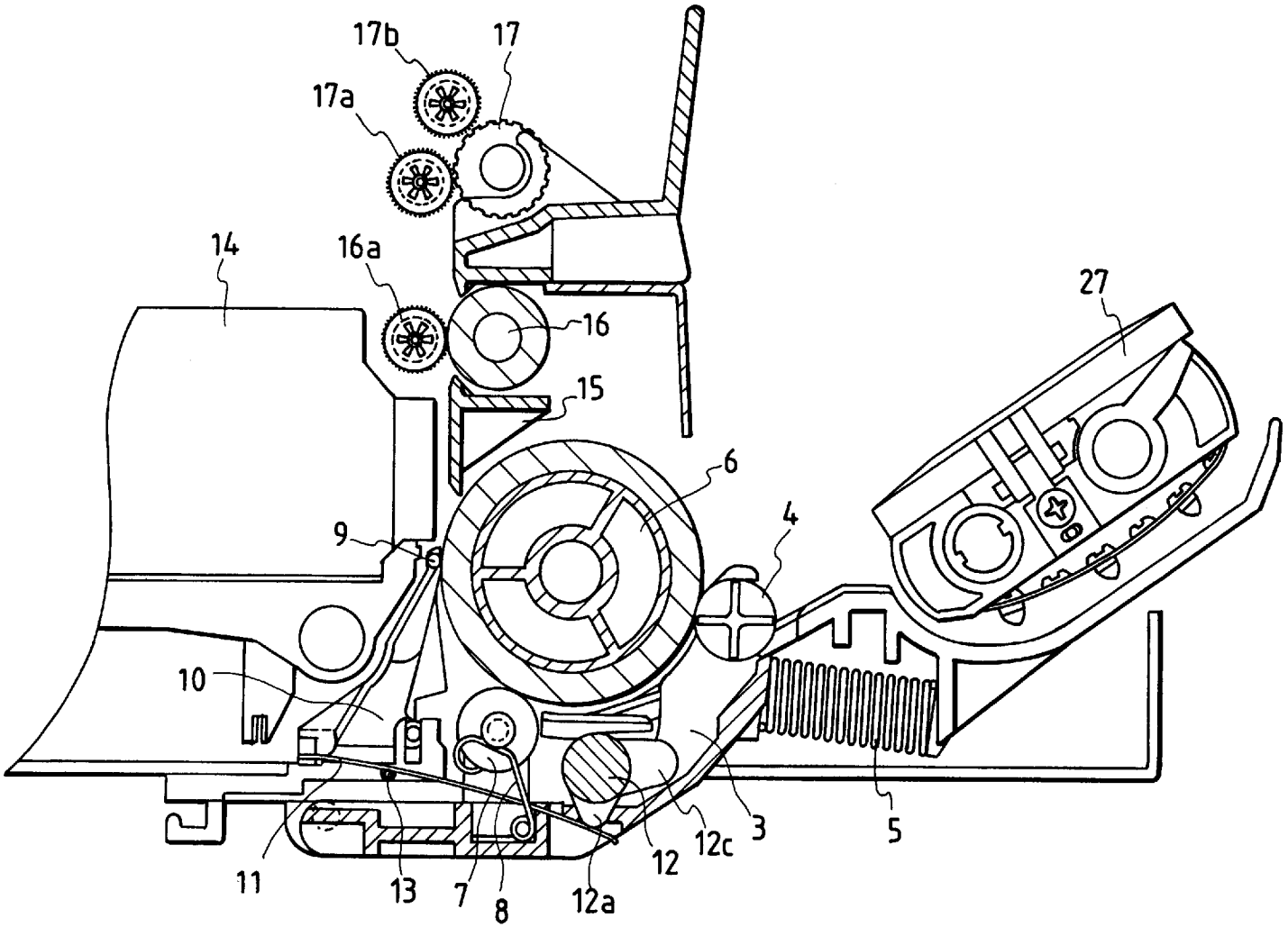
FIG. 4 is a sectional view showing main parts of FIG. 3.

When the cut sheet is used, as a release lever 2 is set to a cut sheet selection condition, as shown in FIG. 4, a pinch roller 4 held by a pinch roller folder 3 is urged against a convey roller (sheet convey member) 6 by a pinch roller spring 5. Similarly, an auxiliary roller 7 mounted on the pinch roller holder 3 for up-and-down movement is urged against the convey roller by auxiliary roller spring 8 provided on the pinch roller holder 3. As a result, the cut sheet supplied from the ASF 1 is conveyed to a recording area through a U-turn path formed around the convey roller 6 by rotation of the convey roller.

In the recording area, a needle roller 9 is held by a needle roller holder 10 and is urged against the convey roller 6 by a needle roller spring 11. In this case, the needle roller spring 11 is flexed by a first projection 12*a* of a release shaft 12, so that an urging force is generated by a spring elastic force around a support point 13. The cut sheet is subjected to a conveying force and is conveyed between an ink jet head (image forming means) 14 and a platen 15. This conveyance is intermittently effected when the ink jet head performs one scan, and an intermittent convey amount corresponds to a length of an array of ink discharge openings of the ink jet head 14 in a cut sheet conveying direction.

Incidentally, in the illustrated embodiment, an ink jet recording system of serial type in which the recording is effected by reciprocally shifting an ink jet head in a direction perpendicular to a sheet conveying direction is used as the image forming means. That is to say, the ink jet head 14 includes fine liquid discharge openings (orifices), liquid passages, energy acting portions disposed in the liquid passages, and energy generating means for generating energy acting on the liquid disposed at the energy acting portions. The head 14 performs the recording by energizing an electrical/thermal converter in response to a record signal and by discharging ink from the discharge opening due to growth and contraction of a bubble generated in the ink by film-boiling caused by thermal energy.

The cut sheet on which the recording was performed by alternately effecting the intermittent sheet conveyance and the ink discharge from the ink jet head 14 is successively conveyed upwardly of the apparatus by a gap roller 16, discharge roller 17 and driven spur wheels 16*a*, 17*a* for urging the sheet against the rollers 16, 17, and is discharged by spur wheels 17*b*. Incidentally, the each spur wheel has small contact area with the sheet so that, even when the spur wheel is contacted with the imaged surface of the sheet, the image formed on the sheet is not distorted by the spur wheel.

A pin-feed tractor 27 is disposed below the ASF 1. A continuous sheet can be conveyed to the convey roller 6 by the pin-feed tractor, so that the recording can be effected on the continuous sheet.

Figure 5A:
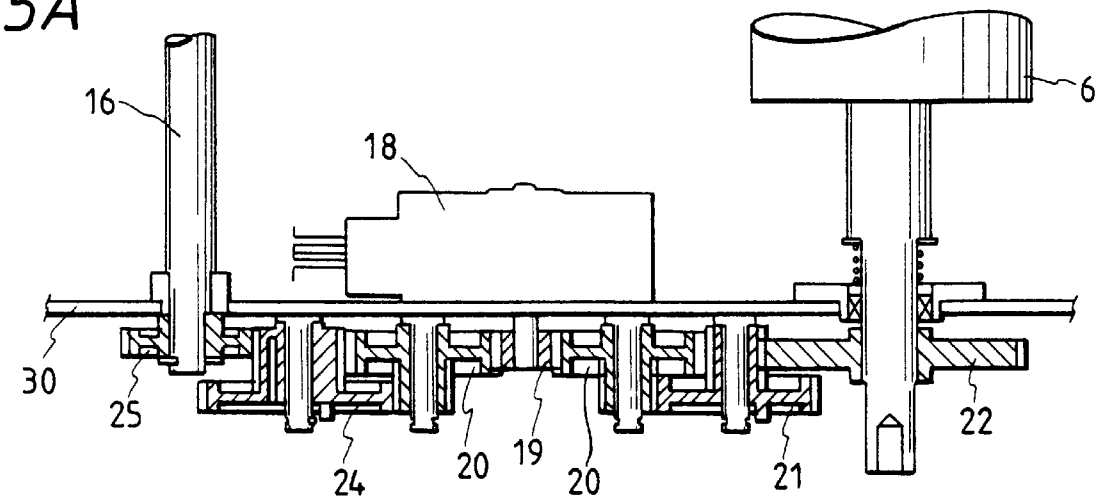
FIG. 5A is a development view of a gear train of FIG. 3, showing transmission of a drive force to a convey roller and a gap roller.
Figure 5B:
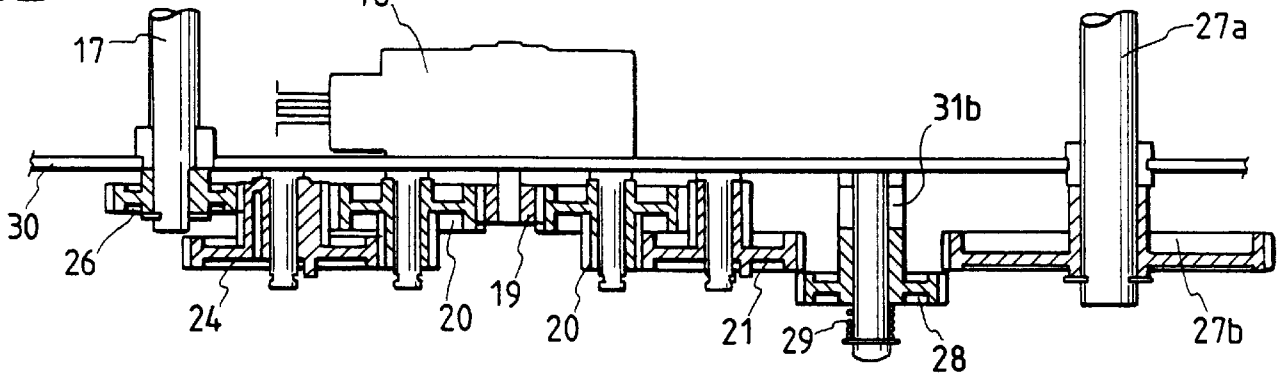
FIG. 5B is a development view of a gear train of FIG. 3, showing transmission of a drive force to a discharge roller and a pin-feed tractor.

Next, a drive transmitting mechanism including the convey roller 6 and the like of the image forming apparatus will be explained. As shown in FIGS. 5A and 5B, a driving force of an LF (line feed) motor (drive source) 18 can be transmitted to the convey roller 6, gap roller 16 and discharge roller 17.

As shown in FIG. 5A, the convey roller 6 is rotated by transmitting the driving force to a convey roller gear (second drive transmitting member) 22 secured to a rotary shaft of the convey roller 6, through a drive transmitting means comprised of a gear train including an LF motor gear (first drive transmitting member) 19 attached to the motor 18, a speed reduction gear (speed reduction member) 20 and an LF speed reduction gear 21. As shown in FIG. 5A, the gap roller 16 is rotated by transmitting the driving force to a gap roller gear 25 secured to a rotary shaft of the gap roller 16, through a drive transmitting means comprised of a gear train including the LF motor gear 19, speed reduction gear 20 and discharge speed reduction gear 24.

Figure 3:
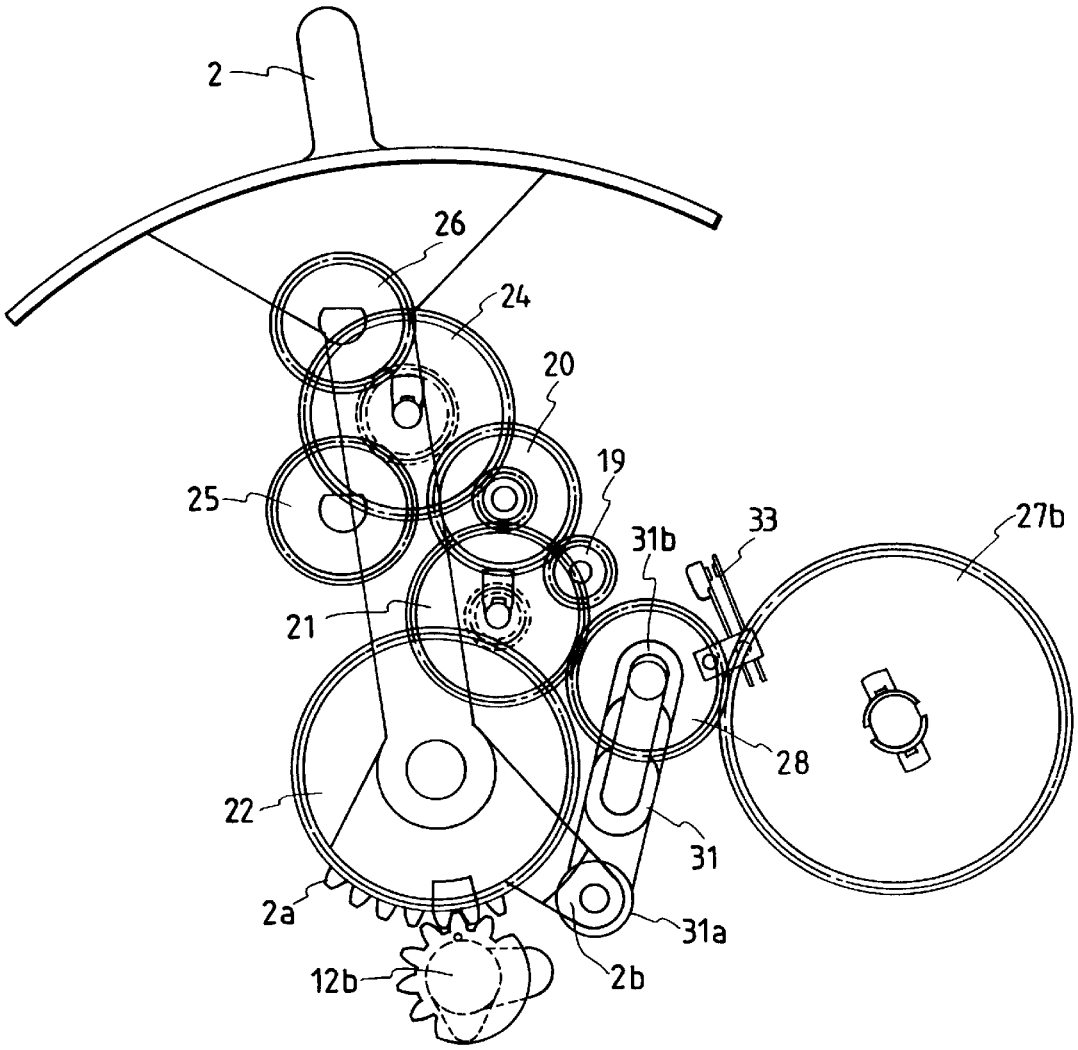
FIG. 3 is a side view of a sheet convey drive system of the image forming apparatus shown in FIGS. 1 and 2, in a condition that a cut sheet is selected.

Similarly, as shown in FIG. 5B, the discharge roller 17 is rotated by transmitting the driving force to a discharge roller gear 26 secured to a rotary shaft of the discharge roller 17, through the LF motor gear 19, speed reduction gear 20 and discharge speed reduction gear 24. Further, as shown in FIG. 5B, the driving force of the LF motor 18 is transmitted to the LF motor gear 19, speed reduction gear 20 and LF speed reduction gear 21. However, since the LF speed reduction gear 21 is disengaged from a clutch gear 28, the driving force is not transmitted to the pin-feed tractor 27. That is to say, although the clutch gear 28 is biased toward a frame 30 (i.e., toward a side where the clutch gear is engaged by the LF speed reduction gear 21), as shown in FIG. 3, the clutch gear 28 is pivotally connected to an arm portion 2*b* of the release lever 2 through a connection portion 31*a* and is normally disengaged from the LF speed reduction gear 21 in opposition to the biasing force by a cam portion 31*b* of a slide cam 31 driven by the rotation of the release cam 2.

In the illustrated embodiment, it is selected so that a step angle of the LF motor 18 becomes 7.5 degrees and a recording width obtained by one scan of the ink jet head 14, i.e., a width of an array of discharge openings becomes ⅓ inch. Further, the resolving power of the ink jet head 14 is 1/360 inch, and the cut sheet can be conveyed by 1/360 inch by one step of the LF motor 18.

Accordingly, in order to reduce load resistance in the U-turn path and to convey the sheet effectively, when a peripheral length of the convey roller 6 is 4.8 inches, a speed reduction ratio Z can be obtained from the following equation:

$$(7.5 \text{ degrees}/360 \text{ degrees}) \times Z \times 4.8 \text{ inches} = 1/360 \text{ inch}.$$

As a result, the speed reduction ratio Z becomes 1/36.

With the above-mentioned arrangement, when the cut sheet is conveyed by ⅓ inch, the number of steps (step number) n of the LF motor is obtained from the following equation:

$$1/3 \text{ inch} = 1/360 \text{ inch} \times n.$$

As a result, the step number n becomes 120. In this case, the number of revolutions (revolution number) of the LF motor 18 becomes 2.5 [revolutions] (=7.5 degrees/360 degrees× 120 steps). In the illustrated embodiment, the speed reduction ratio (1/36) is obtained by three stages (2/5×1/3×5/24), and, when the LF motor 18 is rotated by 2.5 revolutions, the speed reduction gear 20 is rotated by one revolution.

Figure 9:
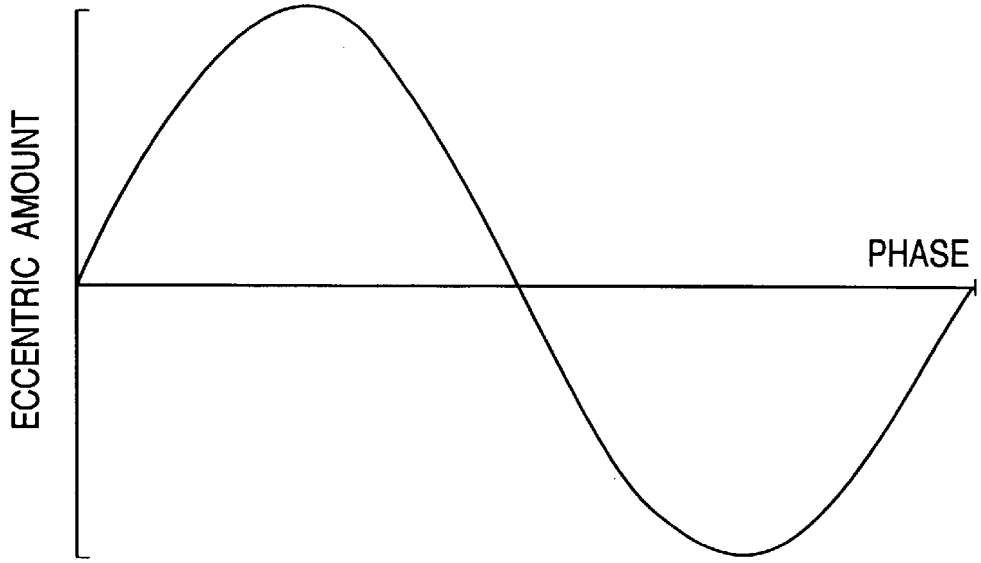
FIG. 9 is a graph showing degree of eccentricity of a gear.
Figure 10:
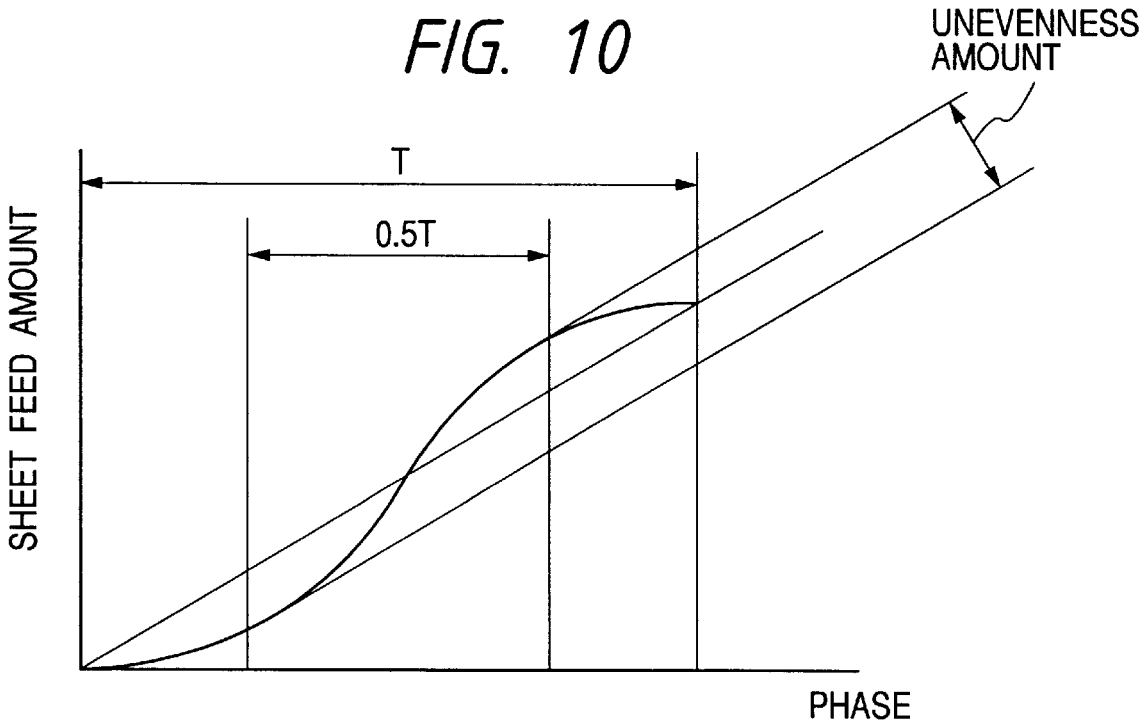
FIG. 10 is a graph showing influence of the eccentricity of the gear upon a line feed convey amount.

Now, the influence of eccentricity of a gear upon line feed conveyance accuracy will be explained. For example, if it is assumed that the eccentricity of the gear becomes a sine wave as shown in FIG. 9, an LF feed amount describes a curve as shown in FIG. 10. That is to say, when the gear is rotated by one revolution (integral number), the LF feed amount reaches on a straight line (eccentric amount=0), with the influence of the eccentricity is eliminated. However, when the gear is rotated by 0.5 revolution, the eccentric amount becomes maximum, thereby providing maximum influence of eccentricity.

In the illustrated embodiment, since the speed reduction gear 20 is rotated by just one revolution, the influence of the eccentricity is eliminated. However, since the LF motor gear 19 rotated by 2.5 revolutions, from the above explanation, the eccentric amount becomes maximum, thereby worsening the conveyance accuracy.

Figure 11:
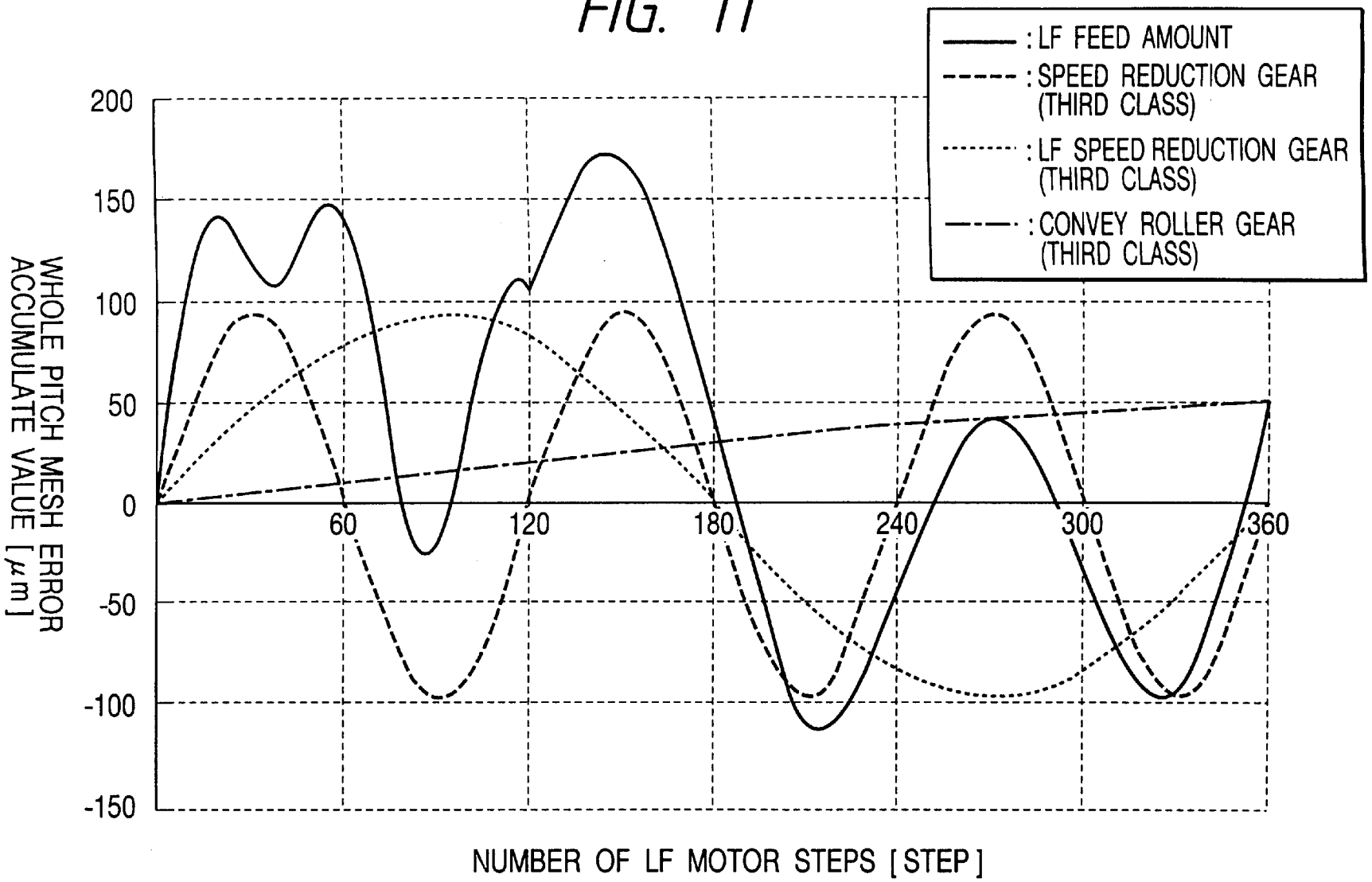
FIG. 11 is a graph showing a line feed amount of FIG. 3 when gears of third class are used.

According to FIG. 11, in the drive speed reduction mechanism according to the illustrated embodiment, gears of third class are used as the above-mentioned gears, and, it is assumed that the eccentricity of gears becomes a sine wave and the eccentric amounts of the gears are equal to whole pitch mesh error.

Now, "third class" is defined from "Composite Error Tolerance for Spur and Helical Gears JGMA116-02" of JGMA STANDARD based on ISO Standard. The gears used in the illustrated embodiment is based on Attached Tables 1 and 2 in Annexed Papers of JGMA116-02.

Definition of terms in the Attached Tables 1 and 2 of JGMA116-02 is as follows:

"(1) Both gear face mesh error (a) Single gear

Variation in center to-center distance when a gear meshed with a checking cylindrical gear (referred to as "master gear" hereinafter) is rotated without any backlash.

(b) Gear pair

Variation in center-to-center distance when a pair of two gears (referred to as "specific gears" hereinafter) meshed with each other are rotated without any backlash.

Incidentally, in case of both single gear and specific gears, the both gear face mesh error includes both gear face mesh error and both gear face one pitch mesh error.

(2) Both gear face whole mesh error

Maximum value of both gear face mesh error during one revolution of single gear or during more than one revolution of greater gear of specific gears.

(3) Both gear face one pitch mesh error

Both gear face mesh error during one pitch meshing."

(extraction from JGMA116-02)

From FIG. 11, it can be seen that, when the LF motor 18 is rotated by 120 steps, the speed reduction gear 20 is rotated by one revolution. In this case, regarding the whole LF feed amount, it can be seen that the influence of eccentricity of the convey roller gear 22 is smaller than that of the LF speed reduction gear 21 disposed at a front stage of the convey roller gear. Even when the LF motor 18 is stopped at a next step (240th step), as is in the 120 steps, regarding the whole LF feed amount, the influence of eccentricity of the LF speed reduction gear 21 becomes greater.

Figure 12:
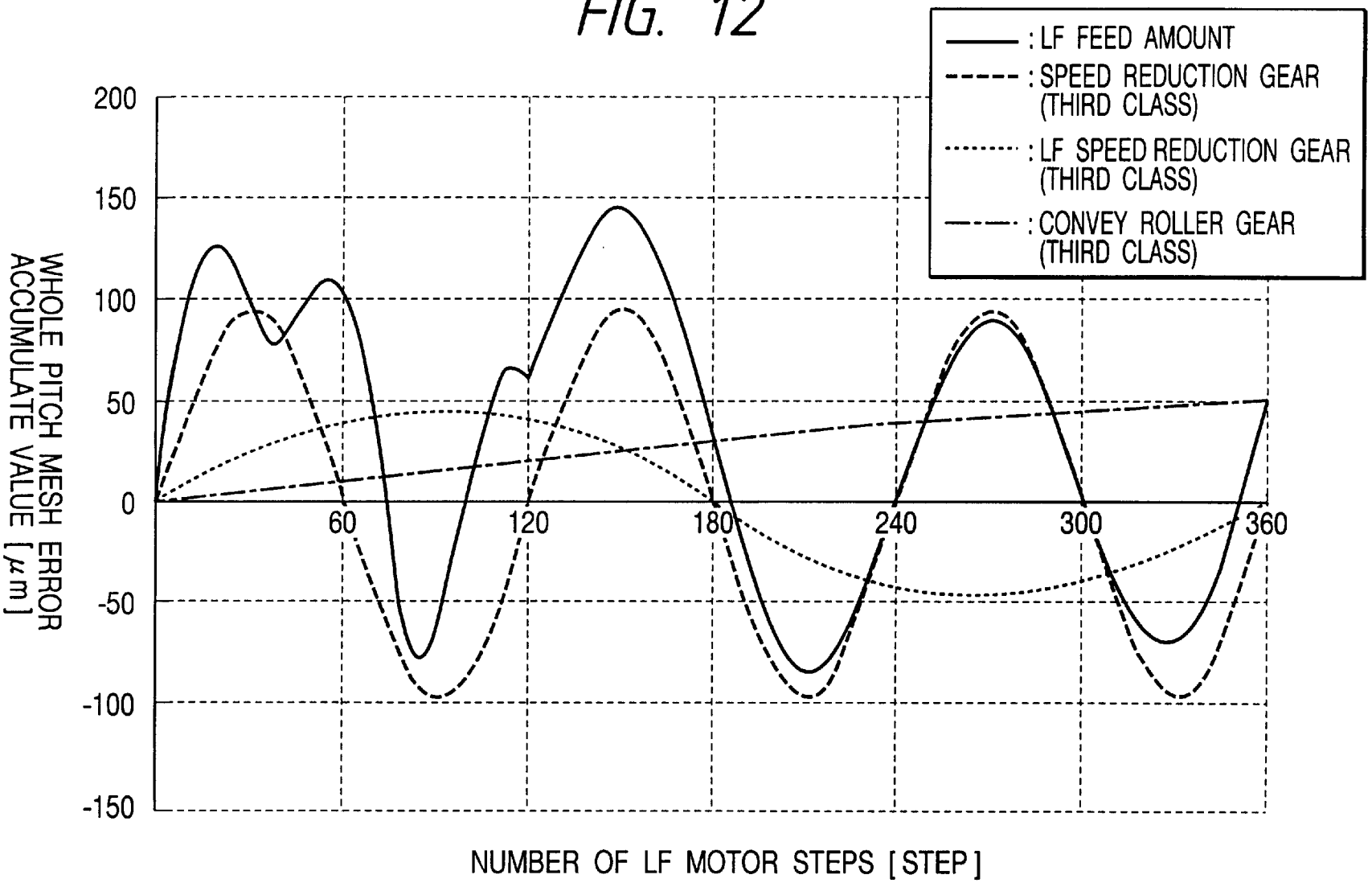
FIG. 12 is a graph showing a line feed amount of FIG. 3 when an LF gear of FIG. 11 has a first class.

Accordingly, as shown in FIG. 12, the error of the LF feed amount per each step of the LF motor 18 can be reduced, for example, by changing the class of the whole pitch mesh error of the LF speed reduction gear 21 (speed reduction member disposed at the front stage of the convey roller gear 22) having the greatest influence of eccentricity to first class.

Figure 13:
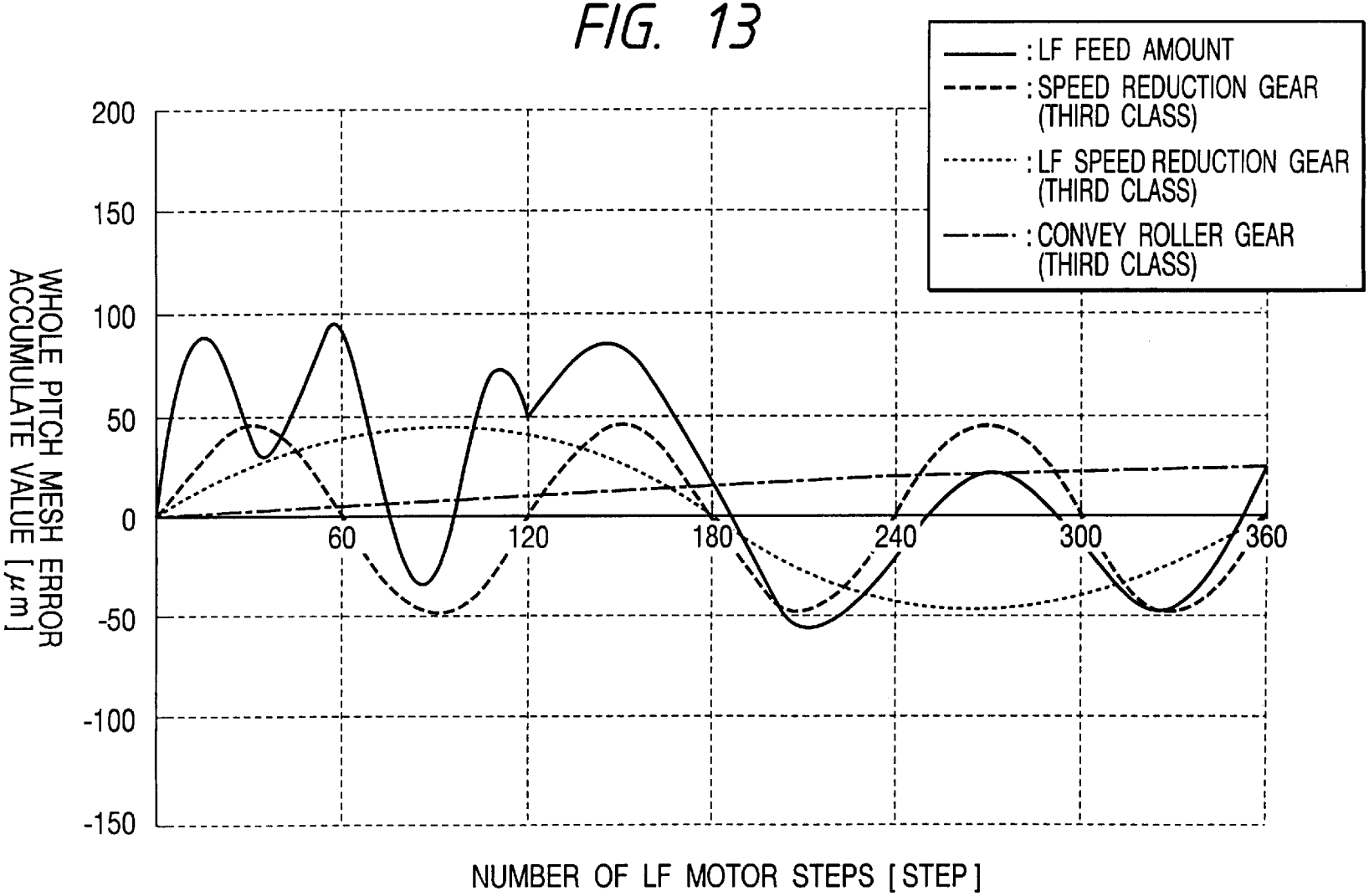
FIG. 13 is a graph showing a line feed amount of FIG. 3 when gears of first class are used.
Figure 14:
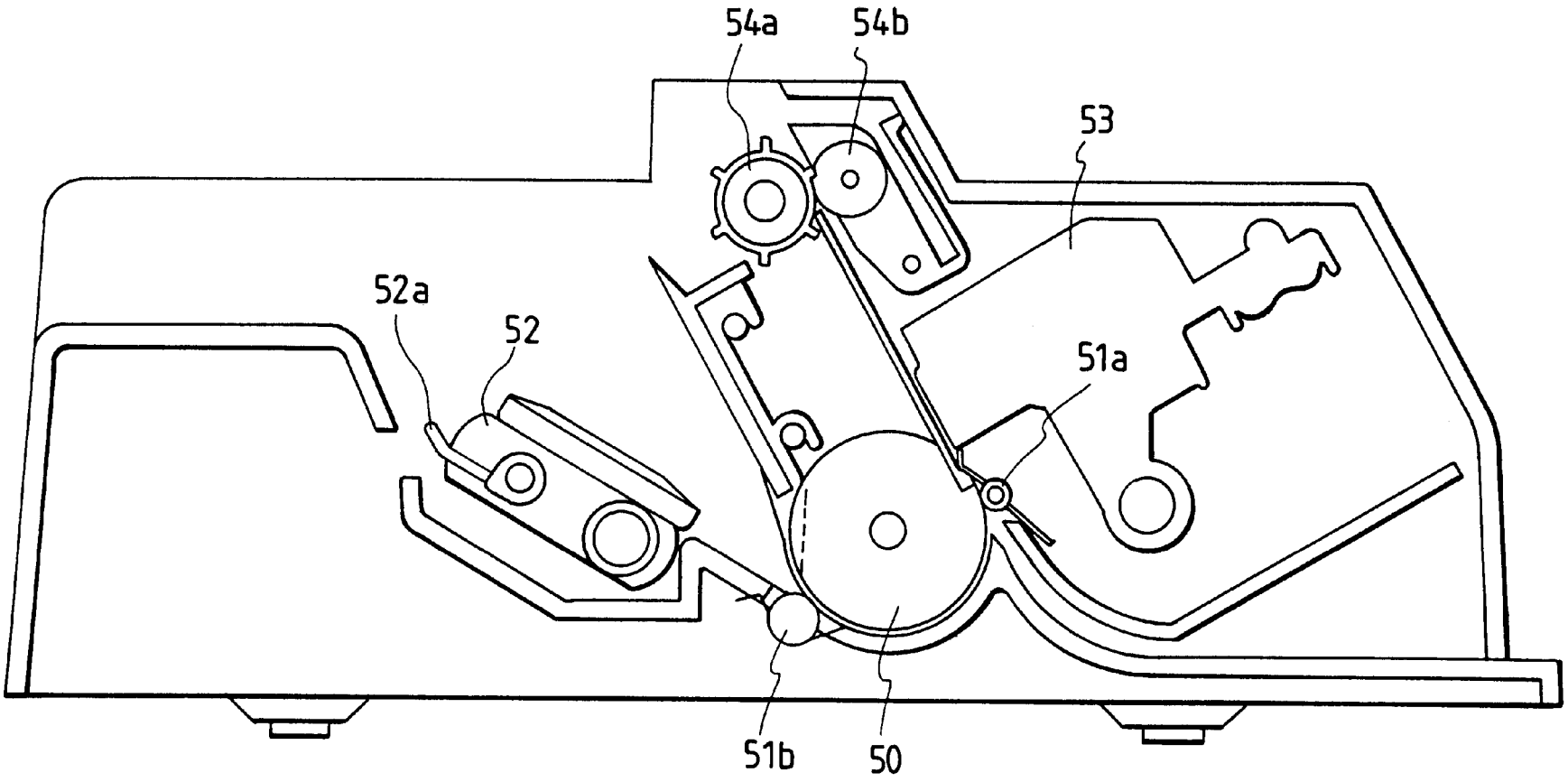
FIG. 14 is a sectional view of a sheet convey drive detection system of a conventional ink jet recording apparatus.

Incidentally, as shown in FIG. 13, if all of the gears constituting the drive transmitting means have first class, of course, the error of the LF feed amount per each step of the LF motor 18 can be minimized. However, as mentioned above, the enhancement of manufacturing accuracy of all gears increases the cost and arises technical problems. Accordingly, as is in the illustrated embodiment, the cost can be suppressed and the conveyance accuracy can be improved by enhancing the manufacturing accuracy of the LF speed reduction gear (disposed at the front stage of the convey roller gear 22 attached to the convey roller 6) having the greatest influence of eccentricity (i.e., only by enhancing the manufacturing accuracy of the gear by which the influence of eccentricity can be reduced most effectively).

That is to say, since a gear for speed reduction is disposed between the LF motor gear 19, speed reduction gear 20 and convey roller gear 22, the influence of eccentricity of the LF motor gear 19 and the speed reduction gear 20 is reduced by a speed reduction action of the speed reduction gear, with the result that the eccentricity does not influence upon the convey roller gear 22 greatly.

Further, in the illustrated embodiment, since the speed reduction ratio is selected so that the speed reduction gear 20 is rotated by just one revolution when the cut sheet is conveyed by the amount corresponding to one scan, the influence of eccentricity of the LF motor gear 19 and the speed reduction gear 20 is further reduced.

Accordingly, only the LF speed reduction gear 21 disposed at the front stage of the convey roller gear 22 makes higher class than the front stage gears (LF motor gear 19, speed reduction gear 20), i.e., first class in the Attached Tables 1 and 2 of JGMA116-02.

As a result, the variation in center-to-center distance when disengaging the LF speed reduction gear 21 and the convey roller gear 22 meshed with each other from the conveying apparatus and rotating without any backlash with urging one of them to the other is, smaller than the variation in center-to-center distance when disengaging the LF motor gear 19 and the speed reduction gear 20 meshed with each other from the conveying apparatus and rotating without any backlash with urging one of them to the other.

By the way, regarding the mesh error in JGMA116-02, the variation in center-to-center distance when the gear (to be measured) meshed with the master gear without any backlash are rotated is measured (by the fluctuation of the master gear).

However, when the gear is actually used, since a center of the gear is supported, the gear itself is not shifted. Accordingly, the variation in center-to-center distance appears as backlash. Backlash means "play on pitch circles of a pair of gears meshed with each other" (JISB-1703). Regarding the backlash, in a mechanism, when a center-to-center distance of gears (even having high accuracy) is set to be greater, the backlash is increased, thereby worsening the conveyance accuracy. The backlash is determined by accuracy of the gears and the center-to-center distance of the meshed gears.

Therefore, the accuracy (class) of the gears and the center-to-center distance of the meshed gears are selected so that the backlash between the convey roller gear 22 and the front stage LF speed reduction gear 21 or the backlash between the LF speed reduction gear 21 and the front stage speed reduction gear 20 becomes smaller than the backlash between the further front stage gears (LF motor gear 19 and the speed reduction gear 20).

Incidentally, as apparent from the drawings, the LF speed reduction gear 21 and the speed reduction gear 20 each comprises two different diameter gear portions secured to a common shaft. Thus, a gear portion of the LF speed reduction gear 21 meshed with the convey roller gear 22 is referred to as a first gear 21*a*, and a gear portion meshed with the speed reduction gear 20 is referred to as a second gear 21*b*. Further, a gear portion of the speed reduction gear 20 meshed with the second gear is referred to as a third gear 20*a*, and a gear portion meshed with the LF motor gear is referred to as a fourth gear 20*b*.

The variation in the center-to-center distance when disengaging the convey roller gear 22 and the first gear 21*a* meshed with each other from the conveying apparatus without any backlash with urging one of them to the other and rotating becomes smaller than the variation in the center-to-center distance when disengaging the fourth gear 20*b* and the LF motor gear 19 meshed with each other from the conveying apparatus without any backlash with urging one of them to the other and rotating. The variation in the center-to-center distance when disengaging the second gear 21*b* and the third gear 20*a* meshed with each other from the conveying apparatus without any backlash with urging one of them to the other and rotating is preferably equal to the variation in the center-to-center distance when the convey roller gear 22 and the first gear 21*a* meshed with each other without any backlash are rotated, but may be equal to the variation in the center-to-center distance when the fourth gear 20*b* and the LF motor gear 19 meshed with each other without any backlash are rotated.

Further, the accuracy (class) of the gears and the center-to-center distance of the meshed gears are selected so that the backlash between the convey roller gear 22 and the front stage first gear 21*a* becomes smaller than the backlash between the front stage gears (fourth gear 20*b* and LF motor gear 19). The backlash between the second gear 21*b* and the front stage third gear 20*a* is preferably equal to the backlash between the convey roller gear 22 and the front stage first gear 21*a*.

Figure 6:
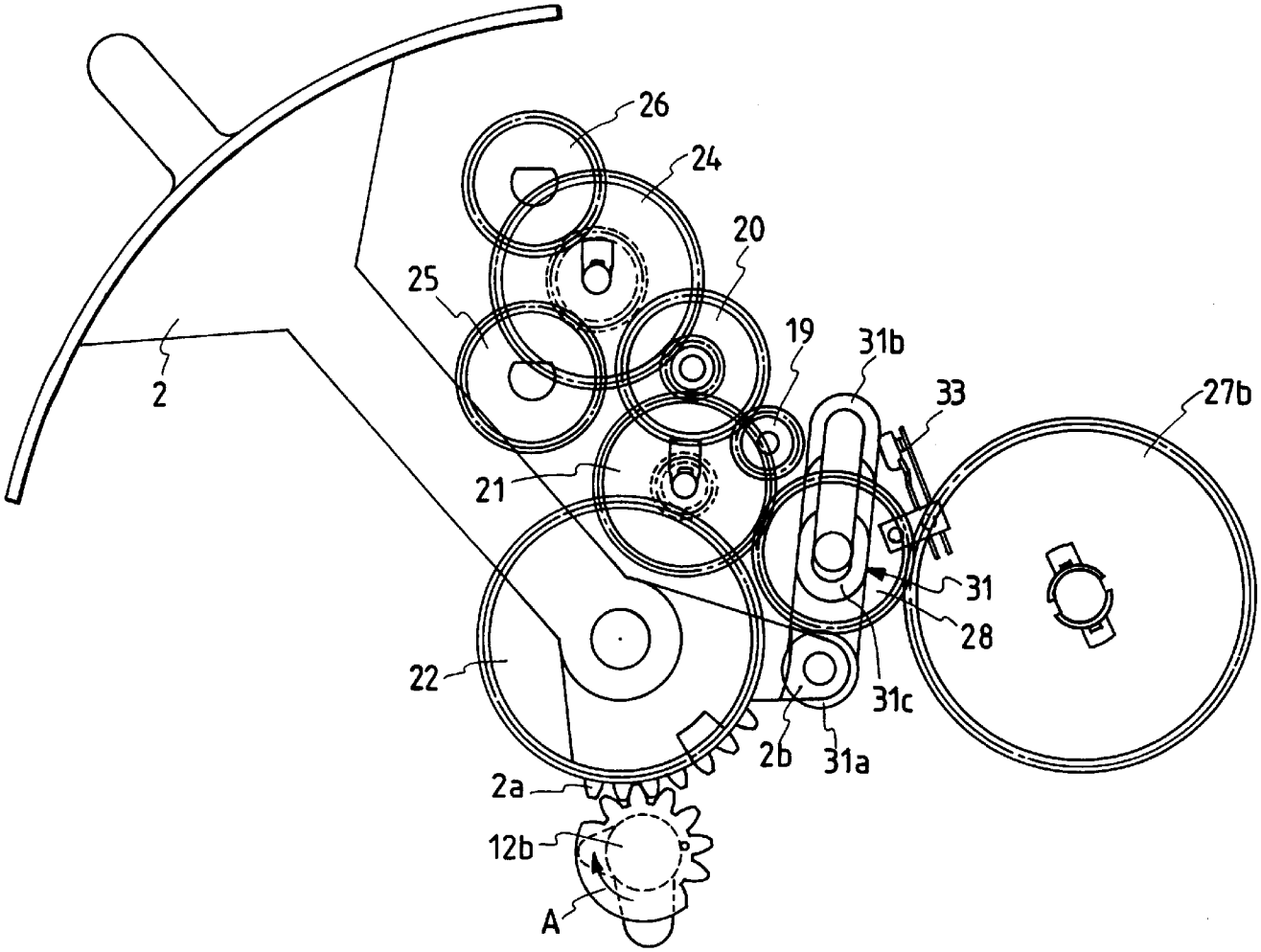
FIG. 6 is a side view of a sheet convey drive system of the image forming apparatus shown in FIGS. 1 and 2, in a condition that a continuous sheet is selected.
Figure 7:
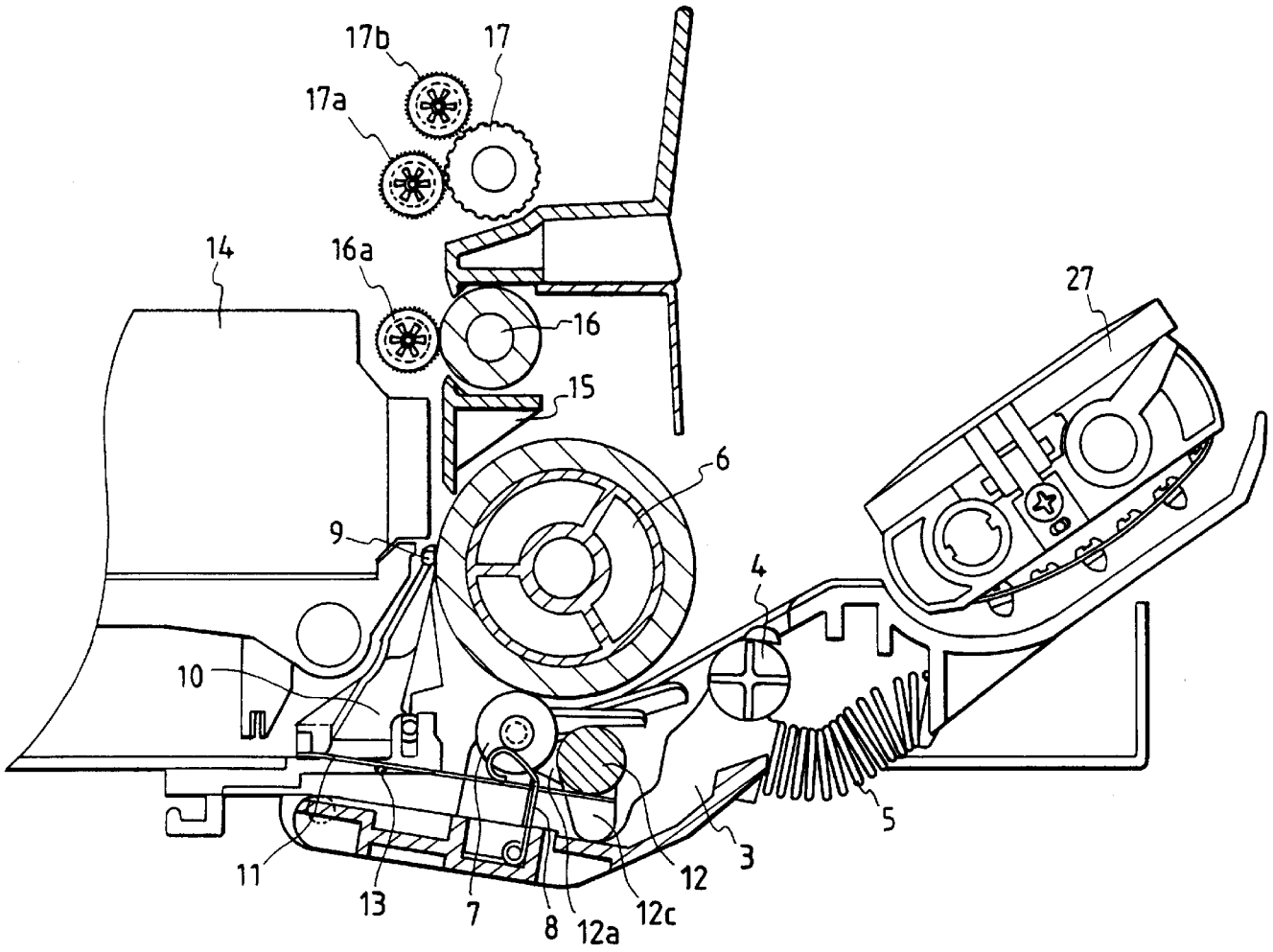
FIG. 7 is a sectional view showing main parts of FIG. 6.

On the other hand, when the continuous sheet (fan-fold sheet) is used, the ASF is not used, and the continuous sheet supplied through the supply opening 32 (FIG. 1) is conveyed by driving the pin-feed tractor 27. As will be described later, as shown in FIG. 6, when the release lever 2 is set to the continuous sheet selection condition, the gear portion 12*b* of the release shaft 12 engaged by the gear portion 2*a* of the release lever 2 is rotated in a direction shown by the arrow A. In consequence of the rotation of the release shaft 12, as shown in FIG. 7, a second projection 12*c* pushes the pinch roller holder 3, thereby separating the pinch roller 4 from the convey roller 6 to shift it out of the sheet convey path. Incidentally, the pinch roller holder 3 has a pivot center disposed on the needle roller holder 10, and the auxiliary roller 7 held by the pinch roller holder 3 for up-and-down movement tries to separate from the convey roller 6, but cannot be separated from the convey roller by the presence of the auxiliary roller spring 8, thereby merely weakening the conveying force to the convey roller 6.

Further, the urging of the first projection 12*a* against the needle roller spring 11 is released, thereby reducing the urging force between the needle roller 9 and the convey roller 6. When the continuous sheet is conveyed to the recording area, as is in the cut sheet, the sheet is successively conveyed upwardly of the apparatus by the intermittent conveyance after one scan of the ink jet head 14, and the recording is effected.

Figure 8A:
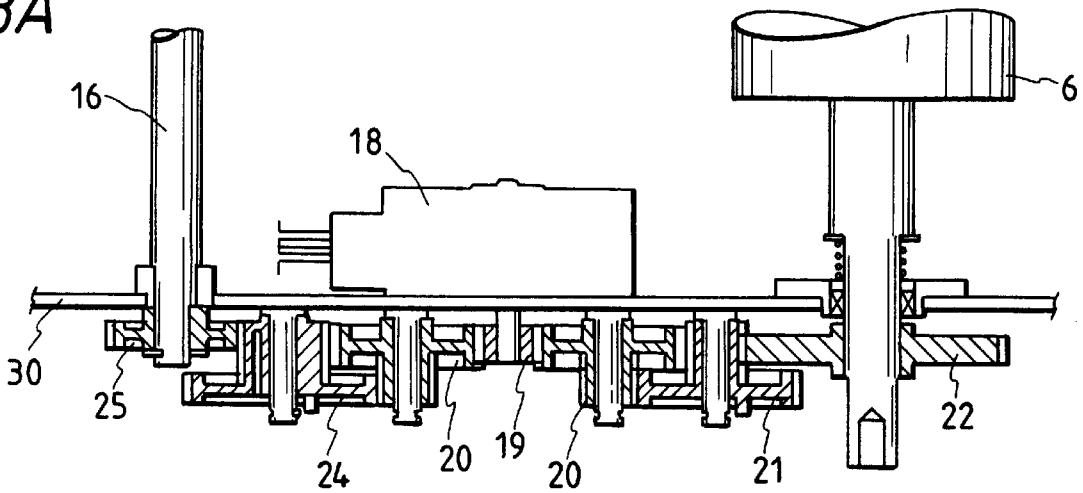
FIG. 8A is a development view of a gear train of FIG. 6, showing transmission of a drive force to a convey roller and a gap roller.
Figure 8B:
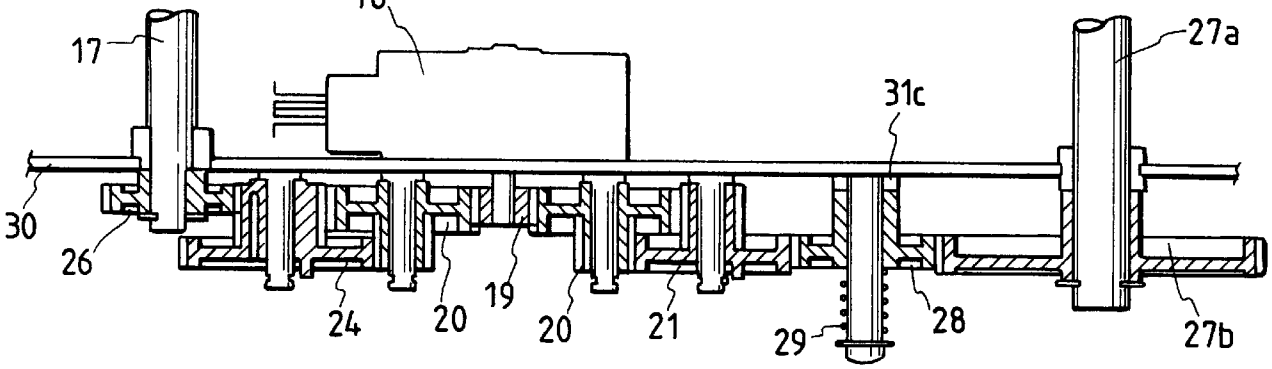
FIG. 8B is a development view of a gear train of FIG. 6, showing transmission of a drive force to a discharge roller and a pin-feed tractor.

By the way, as shown in FIGS. 8A and 8B, the driving force of the LF motor 18 in the continuous sheet selection condition is transmitted to the convey roller 6, gap roller 16, discharge roller 17 and pin-feed tractor 27. Among them, the drive transmission to the convey roller 6, gap roller 16 and discharge roller 17 is the same as above-mentioned cut sheet selection condition.

The driving force to the pin-feed tractor 27 is transmitted to a tractor gear 27*b* secured to a tractor shaft 27*a* through a gear train including the LF motor gear 19, speed reduction gear 20, LF speed reduction gear 21 and clutch gear 28, thereby rotating the tractor shaft 27*a*. That is to say, although the clutch gear 28 is biased toward the frame 30 by the clutch spring 29, in the continuous sheet selection condition, the clutch gear 28 is connected to the tractor gear 27*b* by the cam portion 31*c* of the slide cam 31. At the same time, as shown in FIG. 6, a side portion of the slide cam 31 acts on a tractor detection sensor 33, thereby changing cut sheet mode to the continuous sheet mode electrically.

Incidentally, in the illustrated embodiment, while an example that the gear train is used as the drive transmitting means was explained, the drive transmitting means is not limited to the gears, but may include a belt. Further, while an example that the convey roller is used as the convey member for conveying the sheet was explained, the convey member is not limited to the roller, but may comprise a belt. In addition, while an example that the ink jet recording system is used as the image forming means was explained, for example, a wire dot recording system, a heat sensitive recording system or a heat transfer recording system may be used, so long as the sheet is conveyed and the recording is effected by scanning a recording head in a direction different from a sheet conveying direction.

The ink jet head used in the illustrated embodiment includes heat generating elements disposed in nozzles for injecting ink, so that the ink droplet is discharged from the nozzle by expanding a bubble generated in the ink by thermal energy emitted from the heat generating element.

Further, while an example that the sheet conveying apparatus is used with the image forming apparatus was explained, so long as the sheet conveying mechanism for transmitting the driving force from the drive source to the convey member with plural stages upon conveyance of the sheet by means of the convey member is used, the sheet conveying apparatus can be applied to an original reading apparatus, for example.

According to the present invention, the cost can be suppressed and conveyance accuracy can be improved by enhancing the manufacturing accuracy of the single speed reduction member by which influence of eccentricity is reduced most effectively. As a result, in the image forming apparatus having such a sheet conveying apparatus, good recording accuracy can be obtained. Further, when the sheet is conveyed by the predetermined amount, by setting the speed reduction ratio wherein the speed reduction member disposed at the front stage of the second drive transmitting member is rotated by integral number of revolution(s), the influence of eccentricity can be cancelled, thereby achieving high accurate conveyance.

What is claimed is:

1. A sheet conveying apparatus for conveying a sheet, comprising:

a convey member for applying a conveying force to a sheet;

a drive source for driving said convey member; and a drive force transmitting means for transmitting a drive force from a first drive force transmitting member attached to said drive source to a second drive force transmitting member attached to said convey member through one or more speed reduction members, stepwisely, wherein said first drive force transmitting member, said second drive force transmitting member and said speed reduction members have a manufacturing accuracy; and one of said speed reduction members being disposed to be directly connected to said second drive force transmitting member, said one of said speed reduction members having a manufacturing accuracy which is greater than the manufacturing accuracy of said first and second drive force transmitting members and any speed reduction member other than the speed reduction member disposed to be directly connected to said second drive force transmitting member.

2. A sheet conveying apparatus according to claim 1, wherein said convey member conveys the sheet by a predetermined amount intermittently, and said speed reduction member includes a gear train, so that the sheet is conveyed by the predetermined amount by an integer number of rotations of at least one gear of said gear train.

3. An image forming apparatus for conveying a sheet and for forming an image on the sheet, comprising:

a sheet conveying apparatus for conveying a sheet comprising;

a convey member for applying a conveying force to a sheet, a drive source for driving said convey member, and a drive force transmitting means for transmitting a drive force from a first drive force transmitting member attached to said drive source to a second drive force transmitting member attached to said convey member through one or more speed reduction members, stepwisely, wherein said first drive force transmitting member, said second drive force transmitting member and said speed reduction members have a manufacturing accuracy, and one of said speed reduction members being disposed to be directly connected to said second drive force transmitting member, said one of said speed reduction members having a manufacturing accuracy which is greater than the manufacturing accuracy of said first and second drive force transmitting members and any speed reduction member other than the speed reduction member disposed to be directly connected to said second drive force transmitting member; and an image forming means for forming an image on the sheet conveyed by said sheet conveying apparatus.

4. An image forming apparatus according to claim 3, wherein said image forming means is of ink jet recording system in which the recording is effected by discharging ink in response to a signal.

5. An image forming apparatus according to claim 4, wherein said image forming means discharges the ink from a discharge opening by utilizing film-boiling of ink caused by thermal energy applied by an electrical/thermal converter.

6. An image forming apparatus comprising:

image forming means for forming an image on a sheet;

a convey roller for conveying a sheet to said image forming means by a predetermined amount stepwisely, said convey roller having a rotary shaft;

a convey roller gear secured to said rotary shaft of said convey roller;

a motor for driving said convey roller;

a motor gear secured to an output shaft of said motor; and a gear train including a plurality of gears for transmitting a driving force from said motor gear to said convey roller gear, each of said gears having a manufacturing accuracy, one of said plurality of gears being meshed with said convey roller gear, wherein the manufacturing accuracy of the one of said plurality of gears meshed with said convey roller gear, is higher than the manufacturing accuracy of the other gears which constitute said gear train.

7. An image forming apparatus according to claim 6, wherein when at least one gear of said gear train is rotations by an integer number of rotation, the sheet is conveyed by the predetermined amount.

8. An image forming apparatus according to claim 7, wherein each gear of said gear train sequentially reduces speed of said motor and transmits it to said convey roller.

9. An image forming apparatus according to claim 6, wherein said image forming means forms the image on the sheet when the sheet is stopped.

10. An image forming apparatus according to claim 6, wherein, after the image is formed on the sheet, the sheet is conveyed by said convey roller by the predetermined amount.

11. An image forming apparatus according to claim 6, wherein said image forming means includes an ink jet head for discharging an ink to the sheet to form the image thereon.

12. An image forming means according to claim 11, wherein said image forming means forms the image by ink droplet discharged by thermal energy.

* * * * *

UNITED STATES PATENT AND TRADEMARK OFFICE

CERTIFICATE OF CORRECTION

PATENT NO. : 5,902,058

DATED : May 11, 1999

INVENTOR(S) : YASUSHI KOIKE, ET AL.

It is certified that error appears in the above-identified patent and that said Letters Patent is hereby corrected as shown below:

COLUMN 10,
Line 47, "rotations" should read --rotated--;
Line 48, "rotation," should read --rotations,--; and
Line 56, "claim 6," should read --claim 9,--.

Signed and Sealed this

Twenty-eighth Day of December, 1999

*Attest:*

Q. TODD DICKINSON

*Attesting Officer*

*Acting Commissioner of Patents and Trademarks*